US008967515B2

(12) United States Patent
Pallmann

(10) Patent No.: US 8,967,515 B2
(45) Date of Patent: Mar. 3, 2015

(54) TOOL UNIT AND CUTTING OR PUNCHING TOOL FOR A COMMINUTION DEVICE, AND A DEVICE EQUIPPED THEREWITH

(71) Applicant: Pallmann Maschinenfabrik GmbH & Co. KG, Zweibruecken (DE)

(72) Inventor: Hartmut Pallmann, Zweibruecken (DE)

(73) Assignee: Pallmann Maschinenfabrik GmbH & Co. KG, Zweibruecken (DE)

( * ) Notice: Subject to any disclaimer, the term of this patent is extended or adjusted under 35 U.S.C. 154(b) by 0 days.

(21) Appl. No.: 13/688,874

(22) Filed: Nov. 29, 2012

(65) Prior Publication Data

US 2013/0134250 A1 May 30, 2013

(30) Foreign Application Priority Data

Nov. 29, 2011 (DE) ..... 10 2011 119 589

(51) Int. Cl.
*B02C 18/16* (2006.01)
*B02C 18/18* (2006.01)
*B02C 18/14* (2006.01)

(52) U.S. Cl.
CPC ..... *B02C 18/18* (2013.01); *B02C 18/145* (2013.01)
USPC ..... 241/294; 241/291; 241/293

(58) Field of Classification Search
CPC ..... B02C 2/005; B02C 2/10; B02C 2018/188
USPC ..... 241/293, 294, 295, 242, 243, 291, 292
See application file for complete search history.

(56) References Cited

U.S. PATENT DOCUMENTS

| | | | | | |
|---|---|---|---|---|---|
| 3,314,617 | A * | 4/1967 | Sargood | 241/261.3 |
| 3,857,520 | A * | 12/1974 | Ducasse | 241/189.1 |
| 4,854,508 | A * | 8/1989 | Dicky | 241/236 |
| 5,318,231 | A * | 6/1994 | Bernhardt et al. | 241/236 |
| 5,375,775 | A * | 12/1994 | Keller et al. | 241/19 |
| 6,343,755 | B1 * | 2/2002 | Barclay et al. | 241/236 |
| 6,783,453 | B2 * | 8/2004 | Bueermann et al. | 460/112 |
| 6,854,676 | B2 * | 2/2005 | Dubech et al. | 241/236 |
| 2010/0123034 | A1 * | 5/2010 | Engnell | 241/291 |

FOREIGN PATENT DOCUMENTS

| | | | | |
|---|---|---|---|---|
| DE | 195 37 581 | A1 | 4/1997 | |
| DE | 601 25 934 | T2 | 10/2007 | |
| EP | 1 362 639 | A1 | 11/2003 | |
| EP | 1362639 | * | 11/2003 | B02C 18/14 |
| EP | 1362639 | A1 * | 11/2003 | B02C 18/14 |

* cited by examiner

*Primary Examiner* — Faye Francis
*Assistant Examiner* — Onekki Jolly
(74) *Attorney, Agent, or Firm* — Muncy, Geissler, Olds & Lowe, P.C.

(57) ABSTRACT

A tool unit for a comminution device with a rotor-stator system is provided, in which comminution tools are detachably fastened to tool holders on a rotor circumference and work together with comminution tools located on the stator. In order to shorten the tool replacement downtimes of a device equipped with such a tool unit and to increase its profitability, the tool holder includes a first carrier section and a second carrier section, the rear sides of which sections detachably contact one another in a common contact plane, and on each of the mutually averted front sides of which is located at least one bearing surface for accommodating a tool.

13 Claims, 3 Drawing Sheets

TOOL UNIT AND CUTTING OR PUNCHING TOOL FOR A COMMINUTION DEVICE, AND A DEVICE EQUIPPED THEREWITH

This nonprovisional application claims priority under 35 U.S.C. §119(a) to German Patent Application No. DE 10 2011 119 589.4, which was filed in Germany on Nov. 29, 2011, and which is herein incorporated by reference.

BACKGROUND OF THE INVENTION

1. Field of the Invention

The invention relates to a tool unit for a comminution device, a cutting or punching tool, and a device therefor.

2. Description of the Background Art

From DE 195 37 581 A1, a cutter arrangement for a comminution device is known in which the square blades are attached at the rotor circumference by blade holders. To this end, the blade carriers have a front side pointing in the direction of rotation that the rear side of the blade rests against. The blades are clamped against the blade carriers with the aid of mounting screws, which engage a threaded hole in the blade through holes in the blade carrier from the back. A first disadvantage of this type of cutter arrangement is that all blades have to be replaced individually on the standing rotor. Because of the large number of blades to be replaced, the associated amount of work requires relatively long downtimes. Blade replacement is further complicated by the fact that the mounting screws run tangentially, requiring a driving tool to be placed in the same orientation. However, the space available in the tangential direction towards the rotor is limited for construction reasons, so that it is only possible to manipulate devices such as impact drivers and the like with difficulty, if at all. It has further proven to be a disadvantage that comminution of the feed material is only possible in one direction of rotation of the rotor, which results in asymmetrical wear.

SUMMARY OF THE INVENTION

As alluded to above, the invention relates generally to the field of mechanical process engineering, and within this field more particularly in the comminution of solid, free-flowing materials. A preferred field of application resides in the processing of waste materials or the recovery of useful materials during the course of recycling. Plastics, rubber, wood, wood waste, paper, cardboards, textiles, collections from waste collection, and the like, are mentioned by way of example as possible feed material. A not inconsiderable wear of the comminution tools is associated with the comminution of such materials, and these tools must regularly be replaced by new ones in consequence. The attendant machine downtimes substantially determine the profitability of the comminution operation.

It is therefore an object of the invention is to reduce the downtimes of a comminution device required for tool changing, and in this way to increase the profitability of the comminution process.

The invention is based on the basic concept of arranging multiple processing tools, such as blades for example, on a tool holder that is detachably fastened to the rotor, wherein the resultant tool unit can be manipulated as a whole during replacement of the tools. Thus, when a tool unit is replaced, a plurality of tools are replaced at once. In this concept, moreover, loading of the tool holder can be performed outside the device while operation is ongoing, so that the time required for tool replacement can be concentrated in the exchange of comparatively few tool units. In this way, downtimes required for tool changing are reduced considerably.

According to the invention, the individual blade carriers are divided into two parts, wherein the front side of each carrier section accommodates the tools and the rear side of it contacts the rear side of the other carrier section. Since the carrier sections preferably are identical in structure, any two desired carrier sections equipped with tools can be put together to make a tool unit. Consequently, the number of different components, and hence the required supply, is very small.

The symmetry arising upon assembly of the tool units opens up many possibilities for being able to undertake a tool replacement extremely effectively. Because of the symmetrical arrangement of the tools with respect to the contact plane of the two carrier sections, a tool unit can be rotated by 180° about a radially oriented axis after having been removed from the seat, and then be attached to the rotor again. In this way, the tools that previously were in the lee of the motion are moved to the tool unit's front side pointing in the direction of rotation, with the rotor's direction of rotation remaining the same. The same effect can be achieved by changing the rotor's direction of rotation instead of rotating the tool units. In this way, the device is switched over to unused tools without the need to perform work on the rotor. The service life of the rotor can be doubled in this way, which means that the downtimes are cut in half.

If the tools are attached to the carrier sections using mounting screws, then the ends of the mounting screws opposite the screw heads can advantageously be located in recesses on the rear side of the carrier sections. This ensures unhindered full-area contact of the two carrier sections with one another, while also ensuring that the ends of the mounting screws that are critical for removing the tools are protected from the effects of mechanical forces during comminution operation. In this way, the fastening component in the anchoring region remain undamaged and can thus be removed.

In order to be able to join the two carrier sections together with a precise fit and install them in the rotor in this position, interlocking components are advantageously arranged in the common contact plane carrier sections. In addition to the centering of the two carrier sections achieved in this way, the interlocking components, such as, e.g., feather keys or dowel pins, hold the two carrier sections together to a certain degree due to the frictional connection with the keyway or dowel hole, which facilitates handling thereof during tool replacement without notably hindering the disassembly of a tool unit.

In an embodiment of the invention, provision is made for two adjacent bearing surfaces of a carrier section to be arranged with an offset perpendicular to the bearing surface. Consequently, the tools also have this offset, so that the tools of a tool unit do not all engage the feed material at the same time, but rather successively during the course of the rotor's rotation. The resistance provided by the feed material is evened out in this way, and peak loads are reduced. A comparable effect can be achieved if the bearing surfaces for the processing tools run at an angle to the longitudinal extent of the carrier section.

Fastening devices can include, for example, bolts, screws, etc. wherein the screw head rests, for its protection, in a countersunk hole in the tool. Preferably, the conical inner surface of the countersunk hole is also designed to be convex, resulting in annular contact of the screw head in the countersunk hole. In this way, angular tolerances of the mounting screw can be compensated without jamming occurring.

In an embodiment of the invention, recesses that form seats are arranged in the outer surface of the rotor for attaching the tool units. A tool unit is inserted radially in a seat, where it is clamped tangentially against a wall of the seat by means of a clamping wedge. In this process, the clamping wedge is clamped radially against the bottom of the seat by means of a clamping screw. In this type of fastening method, therefore, the clamping screw is radially accessible and thus can be removed quickly and easily with no limitations on freedom of movement.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
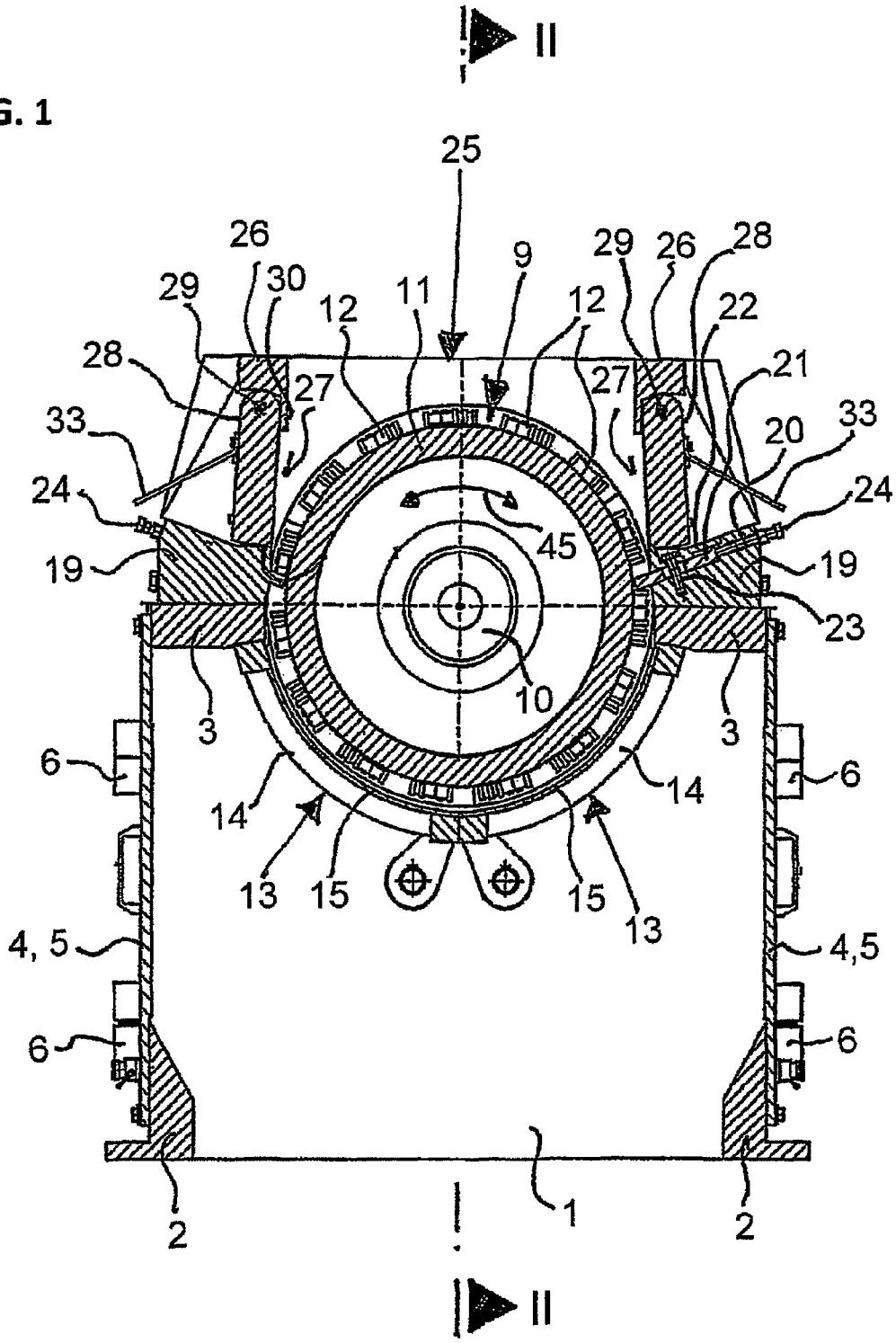
FIG. 1 is a cross-section through a device according to the invention along the line I-I shown in FIG. 2.
Figure 2:
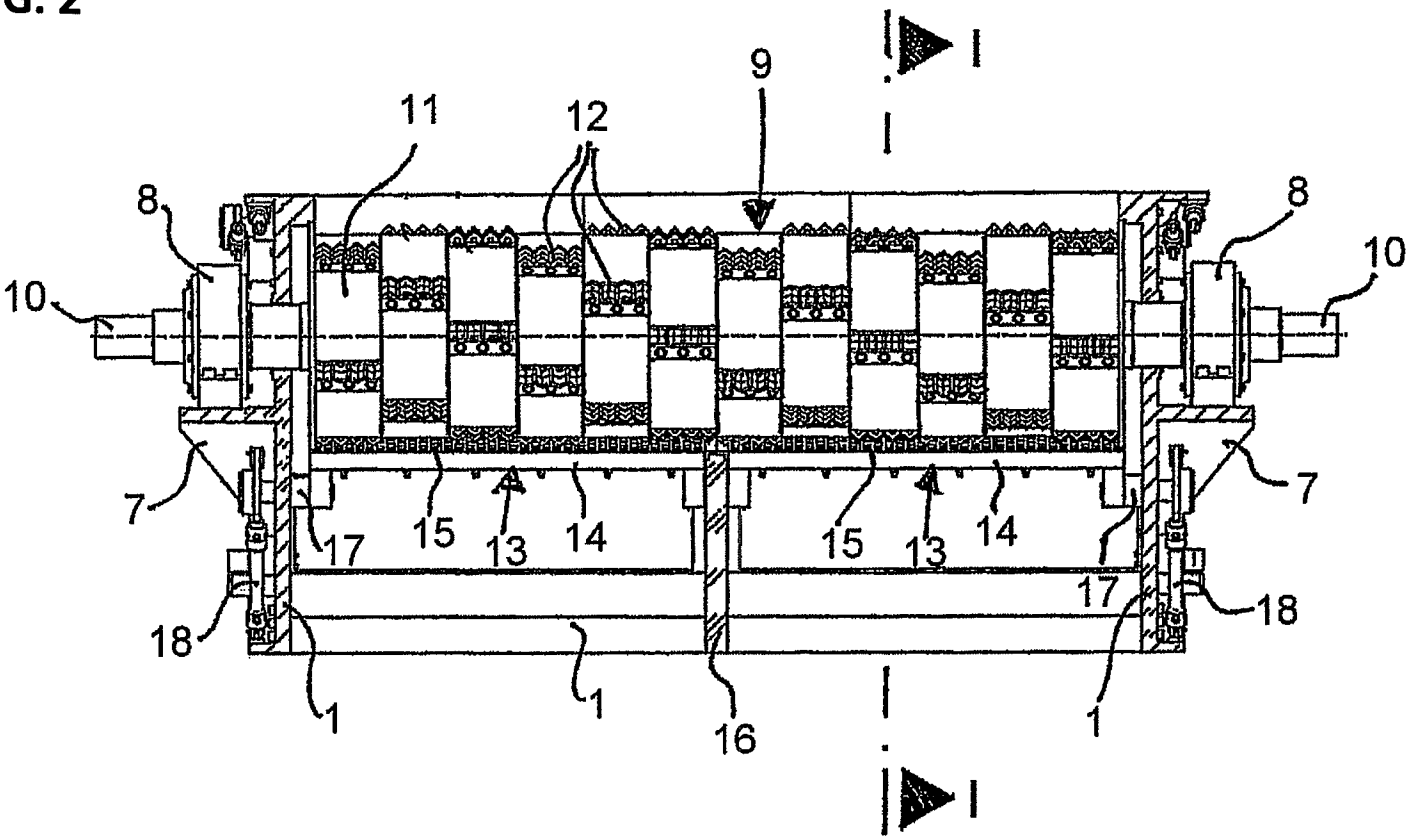
FIG. 2 is a longitudinal section through the device shown in FIG. 1 along the line II-II therein.

FIGS. 1 and 2 show the invention in an overview. The device shown has an essentially symmetrical structure based on a machine base frame with two opposing, plane-parallel transverse walls 1, which are connected to one another at their bottom corners by bottom longitudinal spars 2, and at their top corners by top longitudinal spars 3. The longitudinal walls 4 are composed over their full area of doors 5, which can pivot on hinges 6 in order to open and close the housing, thus ensuring accessibility to the interior of the device.

Welded to the outside of each of the two transverse walls 1 is a bracket 7 for accommodating a shaft bearing 8. The shaft bearings 8 carry a rotor 9, which is composed essentially of a rotor drum 11; a stub shaft 10 engages each end face of the drum in a rotationally fixed manner. The free ends of the two stub shafts 10 extend through openings in the transverse walls 1 as far as the shaft bearings 8. The rotor 9 is equipped over its circumference with a plurality of tool units 12, which are spaced apart from one another both in the circumferential direction and in the axial direction. In this design, each tool unit 12 is replaceably fastened in a seat on the lateral surface of the rotor drum 11, which is described in more detail under FIG. 5. As is indicated by the arrow 45, the rotor 9 can be operated in both directions of rotation.

The bottom circumferential section of the rotor 9 is surrounded by a screen path, which in the present example is composed of four screen elements 13. Each screen element 13 consists essentially of a screen support 14 upon which a perforated screen 15 is mounted. In cross-section, two screen elements 13 extend over nearly one quarter of the rotor circumference in mirror image (FIG. 1); in the longitudinal direction, two screen elements 13 follow one another axially (FIG. 2).

For pivoting support of the screen elements 13, journal bearings 17 in which the screen carriers 14 are rotatably supported are located on the inner side of the transverse wall 1 and on both sides of a partition 16. With the aid of the piston/cylinder units on the outside of the transverse walls 1, whose movable pistons act on the screen supports 14 via working levers, the screen elements 13 can each be pivoted down. With open doors 5, access to the perforated screens 15 and the rotor 9 is thus ensured.

The top longitudinal spars 3 each serve the purpose of stationary mounting of an axially parallel stator device, with a stator tool holder 19, which extends across the entire axial distance of the two transverse walls 1. The top of the stator tool holder 19 is inclined towards the rotor 9 and forms a support surface for platelike stator tools 21, which are clamped against the stator tool holder 19 with the aid of clamping plates 22 and clamping screws 23. In the region of the outer longitudinal sides of the stator tool holder 19, adjusting screws 24 are also visible, with which radial adjustment or readjustment of the stator tools 21 can be undertaken in order to ensure the required working gap between the tool units 12 of the rotor 9 and the stator device. The rotor 9 and the stator device thus have an essentially symmetrical structure with respect to the vertical plane through the axis of rotation.

The feed material is supplied through a vertical feed shaft 25, whose longitudinal walls 26 attach directly to the stator device in the vertical direction. In the region of attachment to the stator devices, the longitudinal walls 26 each have an opening 27 that extends from one transverse wall 1 to the opposing transverse wall. The transverse walls of the feed shaft 25 are reinforced as compared to the transverse walls 1 of the machine base frame, and continue upward beyond the rotor 9.

Each opening 27 is closed by a flap 28, which is mounted in a pivoting manner in the transverse walls 1 in similar fashion to the screen elements 13. The pivot axes 29 of the flaps 28 are located in the region of the upper longitudinal edge of a flap 28, where axial bearing journals are provided for this purpose. To protect the joint gap between a movable flap 28 and the rigid region of the feed shaft 25 that continues upward, each of the longitudinal walls 26 has a strip-shaped skirt 30 along its lower edge on the inside, which overlaps the top longitudinal edge of the flap 28. Extending over the entire length of the flaps 28, on their rear side facing away from the rotor 9, is a deflector plate 33, which is inclined towards its free edge in order to prevent material from collecting in the pivot region of the flaps 28.

The flaps 28 are driven in a similar manner to the screen elements 13, with the aid of piston/cylinder units that are not shown, whose cylinders on the outside of the transverse walls of the feed shaft 25 are attached in a stationary manner to the transverse walls, while their movable actuating pistons are each coupled to a lever seated in a rotationally fixed manner on the bearing journal of the flaps 28. The pivoting motion of the flaps 28 is produced by extending the piston/cylinder units.

FIG. 3 through 6 show the detailed construction of a tool unit 12 and its attachment to the rotor 9. The tool unit 12 comprises a tool holder 34, which is composed of a first carrier section 31 and a second carrier section 32, which are identical in construction. Each carrier section 31, 32 has an approximately cuboid shape with a flat underside 35 and flat faces 36, with its edges being chamfered. The front side 37 of the tool carrier section 31, 32 essentially serves to accommodate any desired number of tools, which in the present example consist of four platelike cutter heads 38 with a square outline arranged next to one another. Each cutter head 38 is oriented such that one of its diagonals is parallel to the direction of the longitudinal extent of the carrier sections 31, 32, and the other diagonal is perpendicular thereto. In this design, two adjacent cutter heads 38 touch in the region of their opposing points, which is explained in more detail under FIG. 6. This arrangement of the cutter heads 38 results in a zigzag shape of the active edge 41 of the tool unit 12 for the comminution.

The top sides of the carrier sections 31, 32 follow the course of the active edge 41 with a certain edge spacing, resulting in a slight radial projection of the cutter heads 38 above the carrier sections 31, 32.

Figure 5:
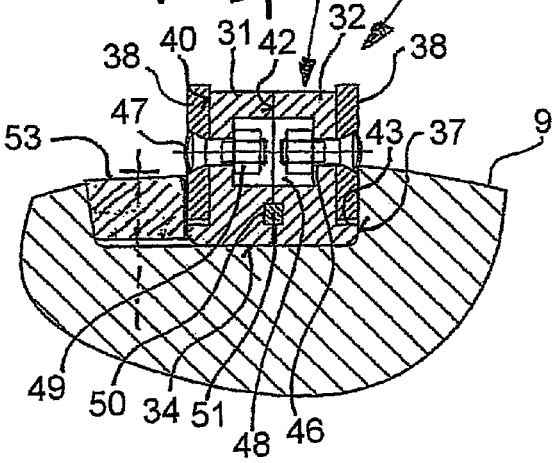
FIG. 5 is a cross-section through the tool unit shown in FIG. 4 along the line V-V therein.

For secure attachment to the carrier sections 31, 32, the cutter heads 38 are arranged in seats 39 on the front side 37 of the carriers 31, 32. Each of the seats 39 is composed of a bearing surface 40 offset towards the rear side 42 of the carrier sections 31, 32. As a result of the offset perpendicular to the bearing surface 40, strip-shaped support surfaces 43 are produced, which accommodate two adjacent sides of a cutter head 38 in a positive-locking manner. The transition between the two support surfaces 43 here is composed of an outward rounding 44. The bearing surfaces 40 each have a central through-hole 46 for passage of a mounting screw 47 (FIG. 5). In order to illustrate this circumstance, the cutter head 38 on the left-hand side in the plane of the drawing is not shown in FIG. 3.

The rear side 42 of the carrier sections 31, 32 is designed to be essentially flat. However, in the region where the through-holes 46 emerge, local indentations 48 are provided in which the ends of the mounting screws 47 are anchored with the aid of nuts 49 that are screwed on. Beneath the indentations 48, approximately halfway to the underside 35 of the carrier sections 31, 32, a keyway 50 that runs parallel to the underside 35 can be seen that is intended to accommodate a feather key 51 in a positive-locking manner.

Figure 3:
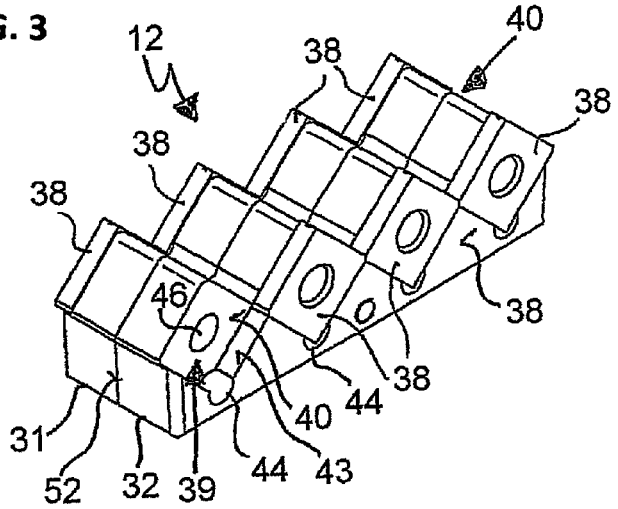
FIG. 3 is an oblique view of a tool unit according to the invention.

As is especially clear from FIG. 3 and FIG. 5, for the purpose of obtaining a tool unit 12 according to the invention and preparing it for installation in a rotor 9, two carrier sections 31, 32 are placed one on the other so their rear sides 42 are congruent. In the common contact plane 52, the feather key is responsible for centering the first carrier section 31 relative to the second carrier section 32. A tool unit 12 that has been prepared in this way is inserted in a seat on the rotor 9, where it is secured solely through clamping with the aid of a radially clamped clamping wedge 53, which exerts on the tool unit 12 a clamping force that is directed tangentially with respect to the axis of rotation. To this end, an inclined side surface of the clamping wedge 53 works together with a wall surface of a tool seat that likewise is inclined (FIG. 5).

Figure 6:
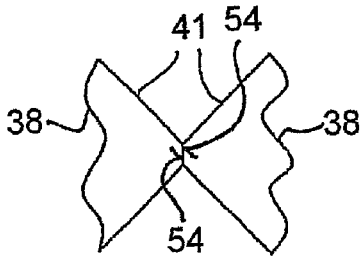
FIG. 6 is a larger scale view of the area labeled VI in FIG. 4.
Figure 4:
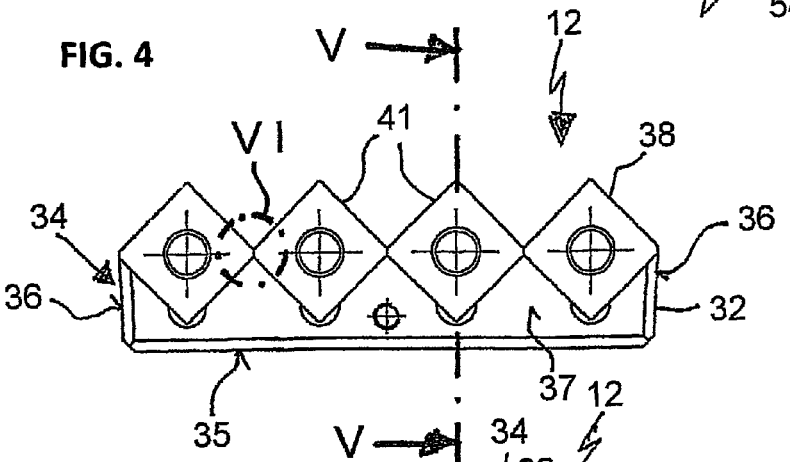
FIG. 4 is a side view of the tool unit shown in FIG. 3.

FIG. 6 shows the contact region between two rectangular or square processing tools—in the form of cutter heads 38—located next to one another on a carrier section 31, 32. The opposing peaks have, at their end regions, truncations 54 that permit full-area contact of the processing tools in the region of the truncations 54. This has the advantage that the active edge 41 composed of the aggregate of the processing tools is preserved as a whole even after initial manifestations of wear have appeared. A size for the truncations 54 that is advantageous for this purpose arises when the diagonal spacing of the truncations is approximately 0.9 times to 0.95 times the spacing of the two other points without truncations.

The invention is not restricted to the present exemplary embodiment, but instead also encompasses embodiments in which a tool extends as a single part over an entire carrier section. In like manner, embodiments are possible in which the active edge formed by the tools has a different shape than a zigzag, for example is straight or wavy.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A tool unit for a comminution device with a rotor-stator system, in which comminution tools are detachably fastened to tool holders on a rotor circumference and work together with comminution tools arranged on a stator, the tool unit comprising:

a first carrier section; and a second carrier section, wherein rear sides of the first and second carrier sections detachably contact one another in a common contact plane, and wherein, on each of the mutually averted front sides of the first and second carrier sections, at least one seat is provided, the at least one seat having at least one bearing surface that accommodates a tool.

2. The tool unit according to claim 1, wherein the tools are attached to the first and second carrier sections via mounting devices, a first mounting device extending through the first carrier section from the front side to the rear side thereof and a second mounting device extending through the second carrier section from the front side to the rear side thereof, wherein the first and second mounting devices are anchored in indentations provided in the rear side of each of the first and second carrier sections.

3. The tool unit according to claim 1, wherein interlocking components are arranged in a predetermined position relative to one another in the common contact plane for centering the first and second carrier sections.

4. The tool unit according to claim 3, wherein the interlocking components comprise a feather key or dowel pin, which in each case engages a keyway or dowel holes on the rear side of the first and second carrier sections.

5. The tool unit according to claim 1, wherein the first and/or second carrier section has at least two bearing surfaces, wherein one bearing surface has an offset relative to the adjacent bearing surface that is perpendicular to the bearing surface.

6. The tool unit according to claim 1, wherein the bearing surface and the rear side of the first and second carrier sections are not parallel, but instead enclose an angle.

7. The tool unit according to claim 1, wherein the tools each have a countersunk hole for the passage of a mounting device, and the inner surface of the countersunk hole has a convex curvature.

8. The tool unit according to claim 1, wherein the tool unit is configured to be symmetrical relative to the contact plane.

9. The tool unit according to claim 1, further comprising at least two tools arranged next to one another on a carrier section, wherein the tools have an essentially rectangular outline or square outline, wherein one of their diagonals is parallel to the direction of the longitudinal extent of the tool unit, and wherein the points of the two tools pointing towards one another each have a truncation with which the tools make area contact with one another.

10. The tool unit according to claim 9, wherein the spacing of the truncations in the diagonal direction is approximately 0.9 times or 0.95 times the diagonal spacing of the two other points without truncations.

11. A device for comminuting feed material with a rotor-stator system, the device comprising a tool unit according to claim 1, wherein the tool has a rectangular outline, the sides of which form the active edges for the comminution of feed material, wherein two diagonally opposing points of the tool have a truncation.

12. The tool unit according to claim 1, wherein the rear sides of the first and second carrier sections directly contact one another.

13. The tool unit according to claim 1, wherein the at least one bearing surface of the first carrier section accommodates a first tool and the at least one bearing surface of the second carrier section accommodates a second tool.

* * * * *